US006349868B1

(12) United States Patent
Mattingly et al.

(10) Patent No.: US 6,349,868 B1
(45) Date of Patent: Feb. 26, 2002

(54) MULTIPURPOSE STAPLER

(76) Inventors: Chris A. Mattingly; Shawn Mattingly, both of P.O. Box 915, Corydon, IL (US) 47112

( * ) Notice: Subject to any disclaimer, the term of this patent is extended or adjusted under 35 U.S.C. 154(b) by 0 days.

(21) Appl. No.: 09/848,578

(22) Filed: May 3, 2001

(51) Int. Cl.[7] ..... B25C 1/04

(52) U.S. Cl. ..... 227/134; 227/113; 227/119; 227/156

(58) Field of Search ..... 227/134, 119, 227/155, 156, 113, 120

(56) References Cited

U.S. PATENT DOCUMENTS

| | | | | | |
|---|---|---|---|---|---|
| 4,051,991 | A | | 10/1977 | Goodchild | 227/155 |
| 4,616,774 | A | | 10/1986 | Yasuda | 227/113 |
| 4,706,866 | A | * | 11/1987 | Ebihara | 227/156 |
| 4,727,610 | A | | 3/1988 | Lin | 7/160 |
| 4,838,470 | A | | 6/1989 | Chang | 227/120 |
| 4,925,082 | A | * | 5/1990 | Kim | 227/120 |
| 4,981,245 | A | * | 1/1991 | Sato | 227/156 |
| 5,690,268 | A | * | 11/1997 | Evans et al. | 227/120 |
| 5,857,608 | A | | 1/1999 | Liau | 227/134 |
| 5,992,724 | A | * | 11/1999 | Snyder | 227/134 |
| 6,076,720 | A | * | 6/2000 | Deng | 227/119 |

* cited by examiner

*Primary Examiner*—Scott A. Smith
(74) *Attorney, Agent, or Firm*—Joseph N. Breaux

(57) ABSTRACT

A multi-purpose stapler including a top stapler assembly including a stapler head for pushing staples; and a forming plate detachably connectable to the top stapler assembly.

1 Claim, 2 Drawing Sheets

MULTIPURPOSE STAPLER

DETAILED DESCRIPTION OF THE STRUCTURE AND USE OF THE INVENTION

The present invention is that of a newly designed stapler. The stapler of the present invention would include a removable lower section, a forming plate, an alignment bar, and a plurality of magnets.

The removable lower section of the stapler would be approximately the front half of the bottom section of the stapler. The forming plate would be the standard forming plate in which the stapler is pushed against in order to get its proper shape while being forced to connect two or more pieces of paper.

The removable lower section would be attached to the rest of the stapler by an attachment clip. The attachment clip could be a clip that would attach in a number of different ways.

The alignment bar of the present invention would be pivotally mounted on the upper portion of the stapler. The alignment bar would include an upper surface and a lower surface. The alignment bar would be in the shape of a "U", each of the two ends of the "U" being rotatably mounted to a side of the upper portion of the stapler.

A plurality of magnets would be located on the lower surface of the alignment bar of the present invention. The magnets on the alignment bar would allow a user to staple papers in the middle of the page by aligning the forming plate with the stapler head, with the stapler in an open position, by aligning the magnets on the lower surface of the alignment bar with the removable lower section. The magnets on the lower surface of the alignment bar and the stapler head would help to align the present invention, as it would not be joined together.

Figure 1:
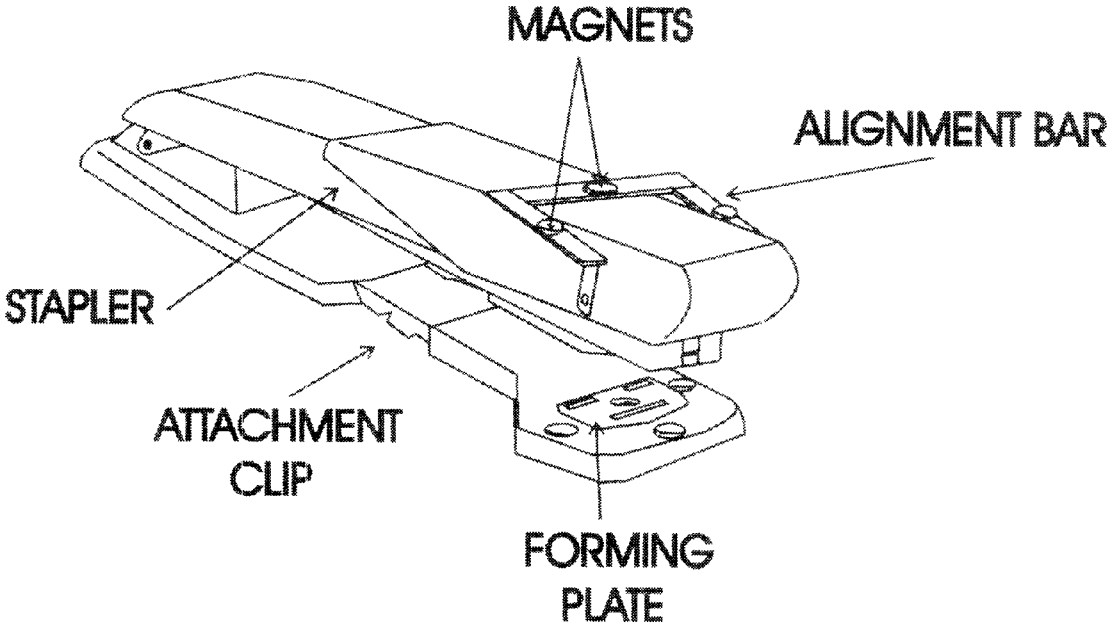
Figure 2:
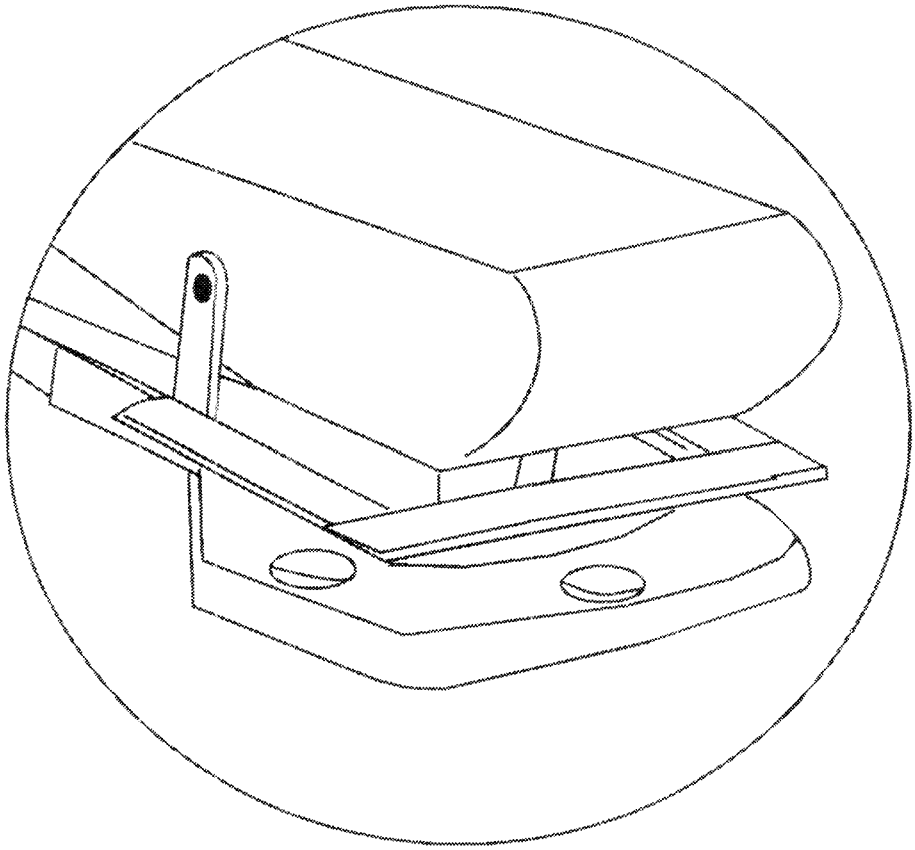

Use of the present invention would allow a user to utilize a stapler in places otherwise inaccessible with a conventional stapler. The present invention can be seen in a perspective view in FIG. 1. A close up perspective view of the alignment bar after the alignment bar has placed in the down position, can be seen in FIG. 2.

The present invention would be fabricated from metal or plastic. In an alternative embodiment, the forming plate of the present invention could be designed as a completely separate item that would not be joined to the main stapler body.

In use, a user would simply remove the forming plate from the present invention, would position it under a stack of papers as desired. The forming plate would be aligned with the main stapler head utilizing the incorporated magnets, and the stapler used as a standard-type stapler. When not in use, the forming plate would be attached to the main stapler body until needed and the alignment bar would be in the back position to ensure normal stapling.

What is claimed is:

1. A multi-purpose stapler comprising:

a top stapler assembly including a stapler head for pushing staples;

a forming plate detachably connectable to the top stapler assembly;

the forming plate including a number of magnets that are oriented and positioned to correspond with magnets attached to a pivoting alignment bar provided on the top stapler assembly such that the magnetic attraction between the magnets attached to the forming plate and the magnets attached to the pivoting alignment bar holds the top stapler assembly and forming plate in alignment for use.

* * * * *